US011300285B2

(12) United States Patent
Bodapati et al.

(10) Patent No.: US 11,300,285 B2
(45) Date of Patent: Apr. 12, 2022

(54) PACKAGE BOILER WITH TANDEM FURNACE TUBES

(71) Applicant: Superior Boiler, LLC, Henrico, VA (US)

(72) Inventors: Sundeep Bodapati, Richmond, VA (US); John R. English, Mechanicsville, VA (US)

(73) Assignee: SUPERIOR BOILER, LLC, Hutchinson, KS (US)

( * ) Notice: Subject to any disclaimer, the term of this patent is extended or adjusted under 35 U.S.C. 154(b) by 78 days.

(21) Appl. No.: 16/282,259

(22) Filed: Feb. 21, 2019

(65) Prior Publication Data

US 2019/0257514 A1 Aug. 22, 2019

Related U.S. Application Data

(60) Provisional application No. 62/633,531, filed on Feb. 21, 2018.

(51) Int. Cl.

| | |
|---|---|
| ***F22B 21/08*** | (2006.01) |
| ***F22B 37/12*** | (2006.01) |
| ***F24H 1/40*** | (2022.01) |
| *F22B 21/22* | (2006.01) |

(52) U.S. Cl.

CPC ..... *F22B 21/086* (2013.01); *F22B 21/081* (2013.01); *F22B 37/12* (2013.01); *F24H 1/40* (2013.01); *F22B 21/22* (2013.01)

(58) Field of Classification Search

CPC ..... F22B 21/081; F22B 21/086; F22B 21/22; F22B 37/12; F24H 1/40

USPC ..... 122/235.19

See application file for complete search history.

(56) References Cited

U.S. PATENT DOCUMENTS

| | | | | |
|---|---|---|---|---|
| 1,919,521 A * | 7/1933 | Lasker | F22B 21/34 | 122/235.19 |
| 1,999,982 A * | 4/1935 | Schmidt | F22B 21/346 | 122/336 |
| 3,693,598 A * | 9/1972 | Cleaver | F22B 21/085 | 122/274 |
| 5,881,551 A * | 3/1999 | Dang | F01D 11/005 | 122/235.17 |
| 6,817,319 B1 * | 11/2004 | Manay | F22B 21/366 | 122/235.11 |
| 6,901,887 B2 * | 6/2005 | English | F22B 21/083 | 122/235.19 |

* cited by examiner

*Primary Examiner* — Steven B McAllister
*Assistant Examiner* — Benjamin W Johnson
(74) *Attorney, Agent, or Firm* — IPCL Group PLC; Anthony Tacconi, Esq.

(57) ABSTRACT

A package water tube boiler having a novel radiant tube design which includes one or more additional tubes situated within the combustion section of the boiler. The novel tube design may be used in both hot water and steam applications.

5 Claims, 3 Drawing Sheets

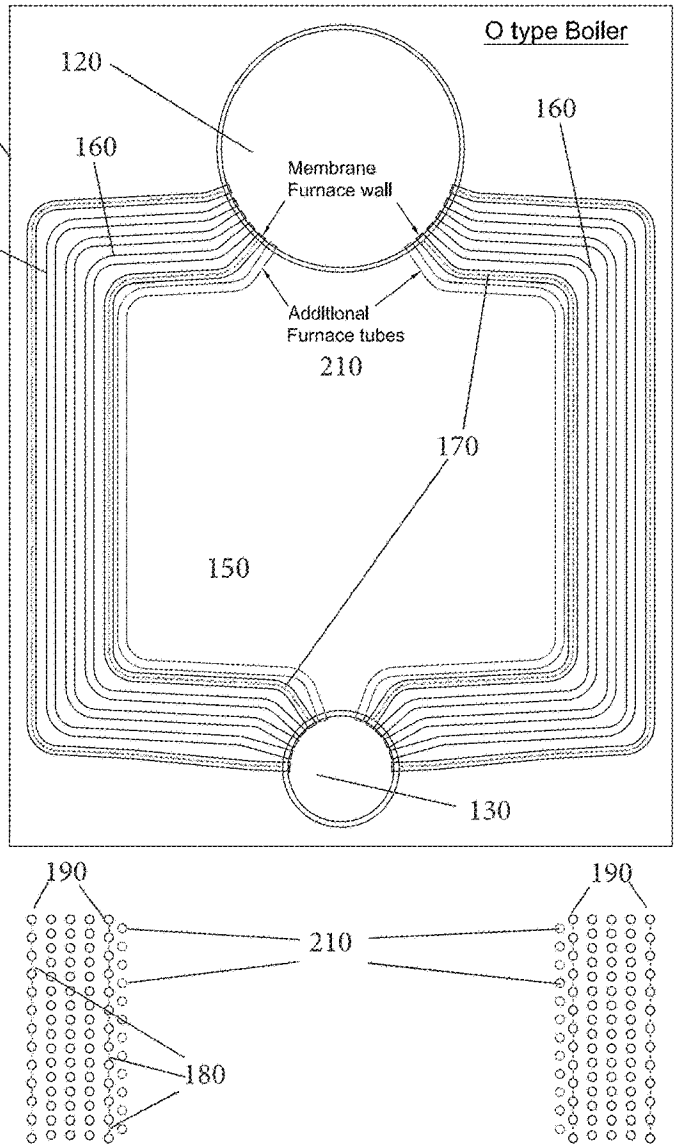
Fig. 5(a)
Fig. 5(b)
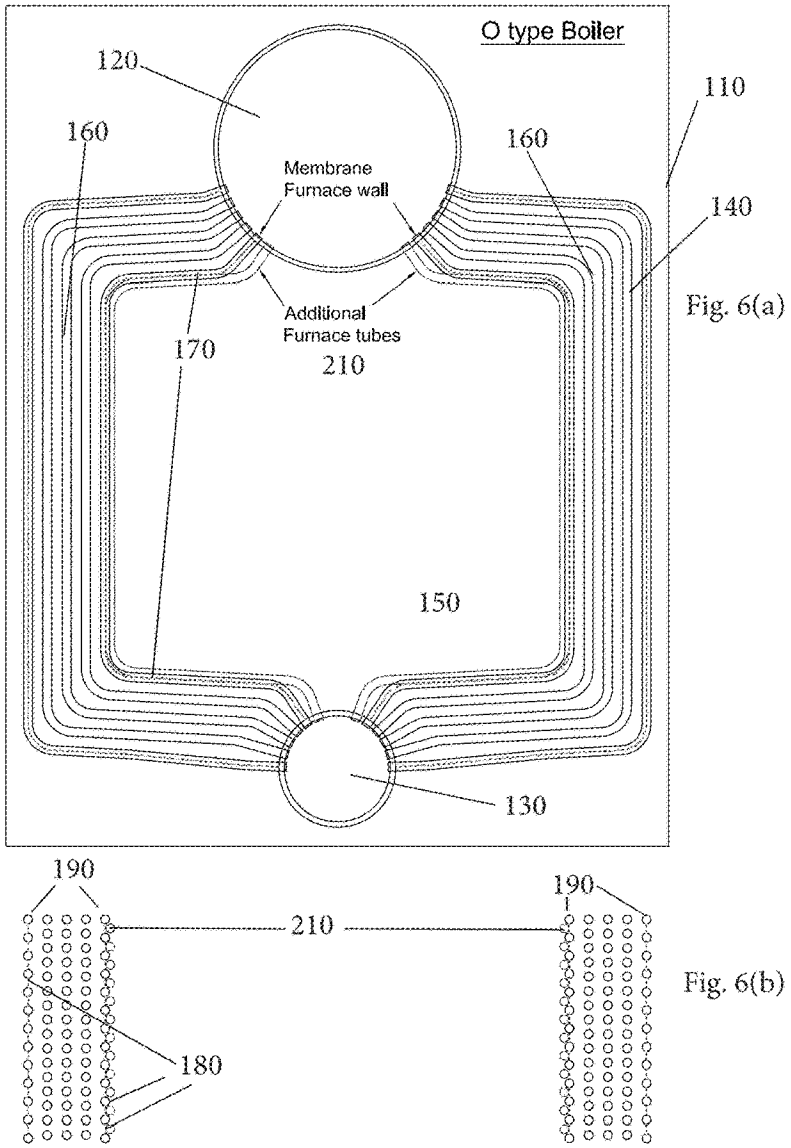
Fig. 6(a)
Fig. 6(b)

PACKAGE BOILER WITH TANDEM FURNACE TUBES

This application claims priority from U.S. Provisional Patent Application No. 62/633,531 filed on Feb. 21, 2018.

FIELD OF THE INVENTION

The invention relates to package water tube boilers, and more specifically, industrial water tube boilers.

BACKGROUND OF THE INVENTION

One of the more common types of boilers, the water-tube boiler, uses heat from fuel burned within a combustion chamber to heat water circulating through a network of internal tubes. Water-tube boilers typically consist of two principal sections, a radiant section and a convective section. The radiant section is the heat transfer surface area of the boiler which is directly exposed to the flame in the combustion chamber. The convective section is the heat transfer surface area shielded from direct exposure to the flame. The radiant section and the convection section each comprise both riser and downcomer tubes connecting a lower water or mud drum to an upper steam drum. The greater amount of steam that is generated, the larger amount of heat energy that may be transferred or used for a desired purpose.

When designing and operating such boilers, the overall furnace volume may be dictated by the heat flux of the system, i.e., certain furnace volumes must be utilized in order to maintain a desired level of heat flux. Reducing the heat flux in the system lowers the incidence of failure of the boiler tubes.

It would, therefore, be advantageous to provide a package tube boiler which provides greater steam output while maintaining a lower heat flux, thereby prolonging the life of the boiler tubes.

DESCRIPTION OF THE DRAWINGS

FIG. 1(*b*) is a planar cross-sectional view of a Ds-type water tube boiler having additional furnace tubes.

FIG. 2(*b*) is a planar cross-sectional view of a Ds-type water tube boiler having an alternate configuration of additional tubes.

FIG. 3(*b*) is a planar cross-sectional view of a D-type water tube boiler having additional furnace tubes.

FIG. 4(*b*) is a planar cross-sectional view of a D-type water tube boiler having an alternate configuration of additional furnace tubes.

FIG. 5(*a*) is a transverse view of an O-type water tube boiler having an alternate configuration of additional furnace tubes.

FIG. 5(*b*) is a planar cross-sectional view of an O-type water tube boiler having an alternate configuration of additional furnace tubes.

FIG. 6(*a*) is a transverse view of an O-type water tube boiler having an alternate configuration of additional furnace tubes.

FIG. 6(*b*) is a planar cross-sectional view of an O-type water tube boiler having an alternate configuration of additional furnace tubes.

DETAILED DESCRIPTION

The invention comprises a package water tube boiler having a novel radiant tube design which may be used in both hot water and steam applications. The novel tube design includes one or more additional tubes located within the combustion section of the boiler.

Figure 1A:
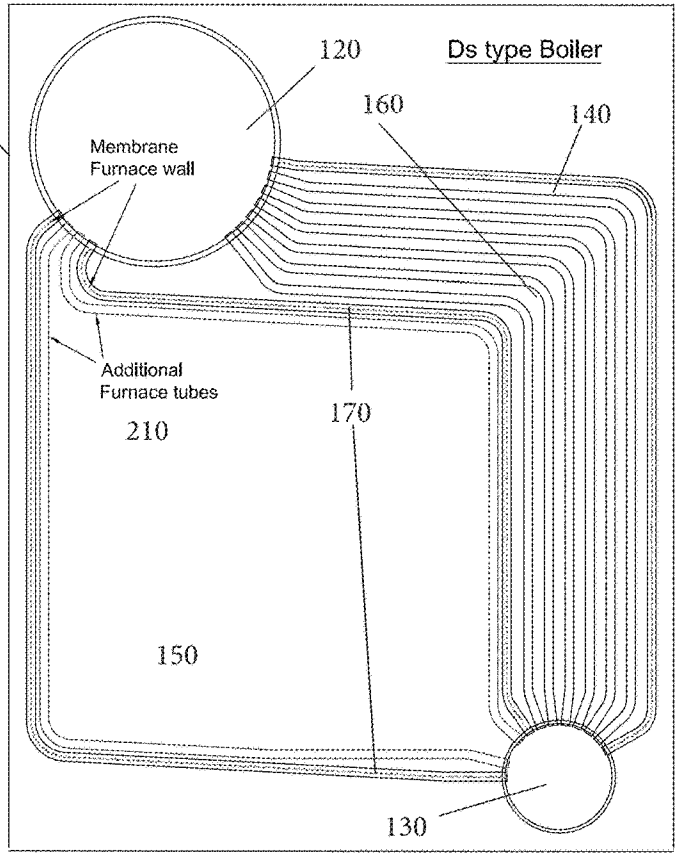
FIG. 1(*a*) is a transverse view of a Ds-type water tube boiler having additional furnace tubes.
Figure 1B:
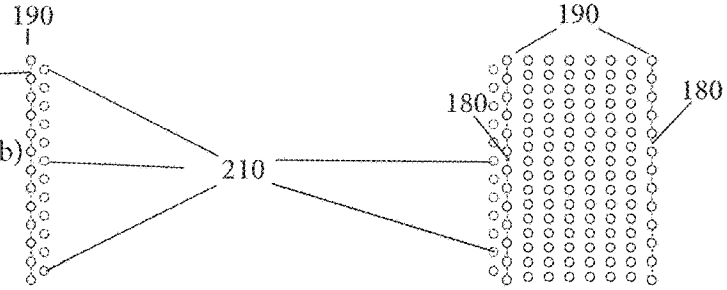
Figure 4A:
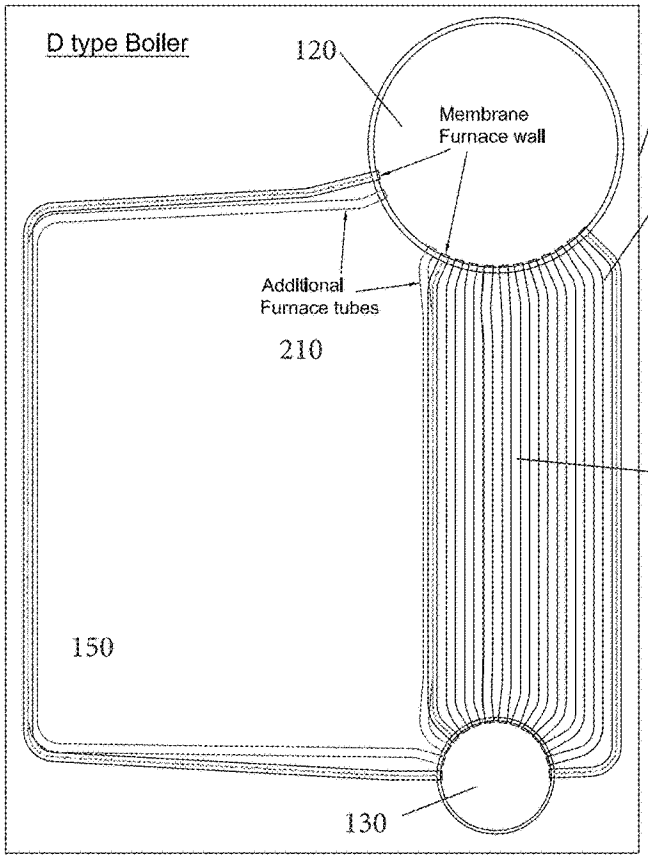
FIG. 4(*a*) is a transverse view of a D-type water tube boiler having an alternate configuration of additional furnace tubes.
Figure 4B:
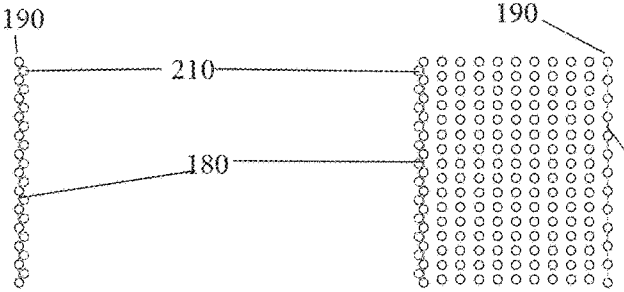
Figure 3A:
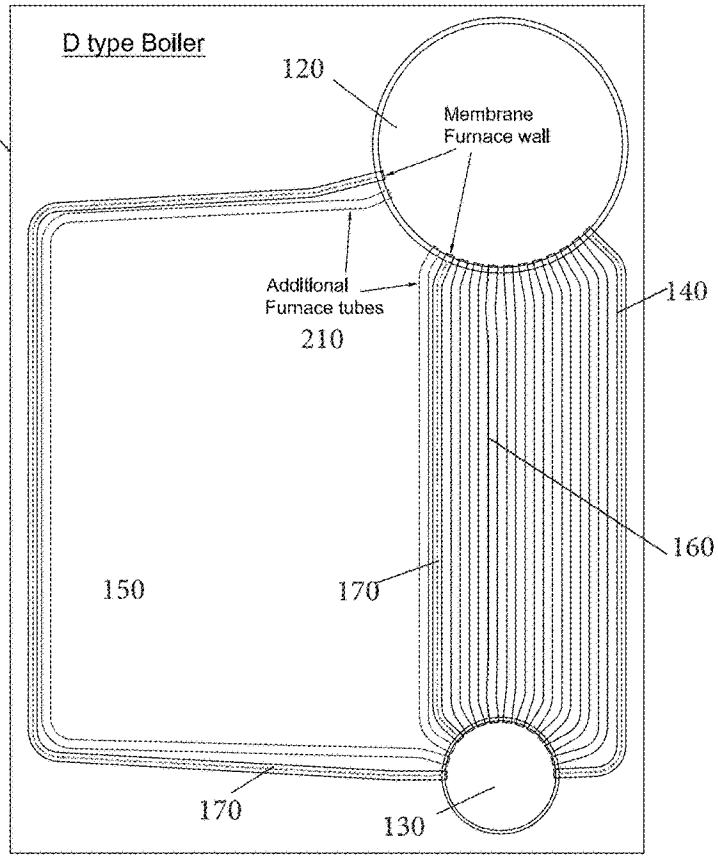
FIG. 3(*a*) is a transverse view of a D-type water tube boiler having additional furnace tubes.
Figure 3B:
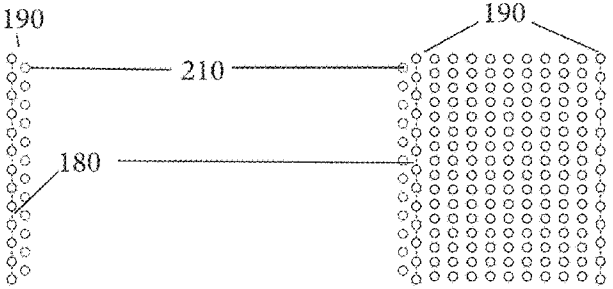

FIGS. 1(*a*), 2(*a*), 3(*a*), 4(*a*), 5(*a*) and 6(*a*) are transverse sections of boiler units having the novel tube configuration disclosed herein. Referring to FIG. 1(*a*) as a general example, a boiler includes a housing 110 having four walls which, inter alia, reduce thermal loss. An upper steam drum 120, a lower mud drum 130, and a plurality of conduits 140, i.e., steel tubes, are disposed within the housing 110. A combustion chamber 150, herein referred to as a furnace, is included within the housing 110. The furnace 150 is essentially an enclosed space for the combustion of fuel. The furnace is also designed to direct the hot flue gasses through the boiler.

A plurality of carbon steel tubes 140 connects the lower drum 130 to the upper drum 120. In FIGS. 1(*a*) and 2(*a*), the convection tubes define a convection section 160 of the boiler. One or more external downcomers (not shown) may be used, in addition to tubes in the convection section, to transport cooler water from the upper drum to the lower drum.

The furnace 150 has inside and outside furnace walls which are formed by radiant tubes 170 connected to one another by welded steel fins 180, also referred to as membrane tubes. A plurality of joined membrane tubes 170, including inboard radiant riser tubes and outboard radiant tubes, form a membrane furnace wall 190 or baffle which separates the radiant section of the boiler from the convection section 160 of the boiler. It will be recognized that it is also possible to separate the two sections via the placement of tangent tubes or some other similar arrangement in lieu of membrane wall tubes.

The portion of the radiant tubes 170 which face the combustion chamber 150, i.e. essentially one side of the tubes, are radiant heating surfaces as they are exposed to direct flame. Therefore, the heating surface of a radiant tube in a standard configuration is approximately one-half of the circumference of the tube.

Figure 2A:
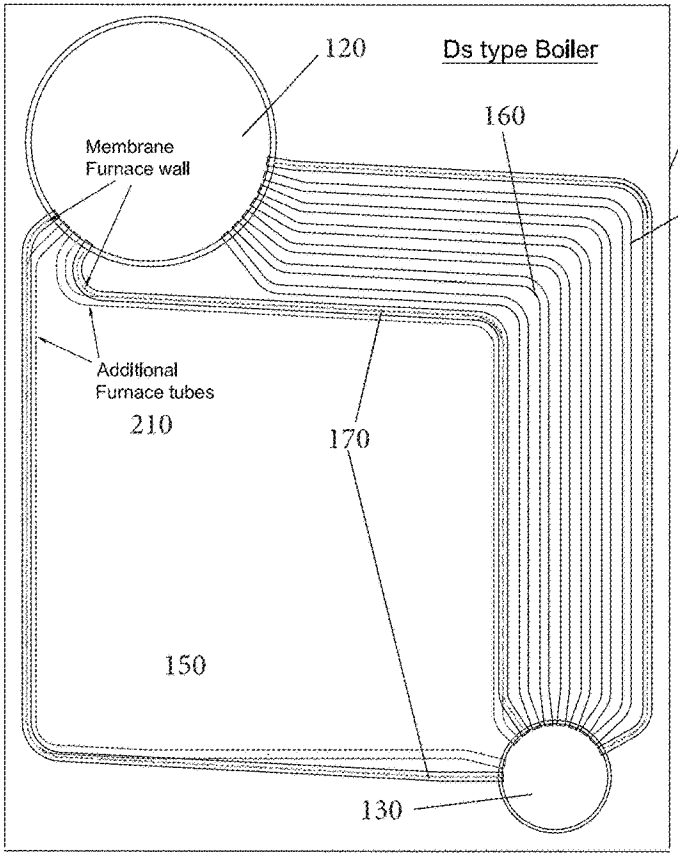
FIG. 2(*a*) is a transverse view of a Ds-type water tube boiler having an alternate configuration of additional tubes.
Figure 2B:
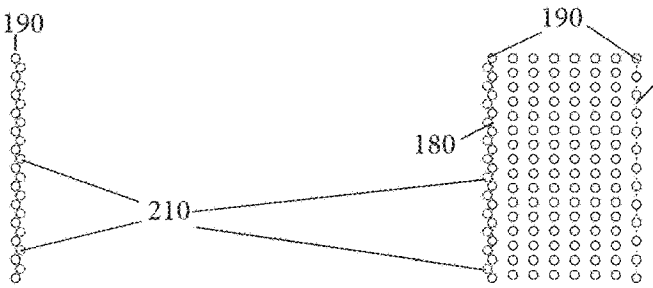

In the instant invention, one or more additional radiant tubes 210 are installed within the furnace section. The additional furnace tube(s) 210 is/are inserted between the standard radiant membrane tubes 170. As shown in FIG. 2(*b*), the additional furnace tube(s) 210 may be immediately proximate to the membrane furnace wall 190, or, alternatively as reflected in FIG. 1(*b*), the additional tube(s) 210 may be positioned further away from the membrane furnace wall 190. The heating surface of the additional radiant tubes is, essentially, the entire circumference of the tube. The additional radiant tubes 210 may be composed of the same material as the tubes in the convection section 140, i.e., carbon steel, or any other suitable material. The type of material may be selected depending on the heat exchange characteristics, corrosion and durability properties, or other pertinent characteristics.

The embodiments set forth in the attached figures reflect additional furnace tubes on both walls of the respective furnaces but that need not be the case. Additional tubes 210 can be added to one or both of the inboard or outboard walls. Further, the number of tubes 210 may be varied along each wall. FIGS. 1(*a*), 2(*a*), 3(*a*), 4(*a*), 5(*a*), and 6(*a*) illustrate various embodiments of this configuration in D-type, Ds-type, and O-type boilers, respectively. It will be noted that the implementation of this invention need not be limited to the foregoing boiler types/configurations but to any analogous boiler assembly.

Inserting an additional furnace tube 210, or tubes, vastly increases the effective heating surface in the furnace. The heating surface could be almost doubled, if not tripled, or increased even further, from the standard configuration. By way of example, the effective furnace area in a traditional 80,000 lb/hr boiler would be 810 sq. ft. The inclusion of additional dual tubes, i.e., on both sides of furnace, would increase the effective furnace area to 1,494 sq. ft. For the traditional 80,000 lb/hr boiler the typical heat flux is 121,870 But/hr sq. ft. compared to 66,372 But/hr sq. ft. with a dual tube configuration as set forth herein.

The increase in radiant heating surface provides numerous advantages. First, the configuration provides for a substantial increase in the amount of steam generation. Aside from increased steam capacity, the overall footprint of the boiler can be reduced while still generating an equivalent amount of steam. Second, the configuration can also be used to reduce the flue gas temperature entering the convection section and thereby reduce the heat flux of the system. Normally, gas temperature would be lowered by increasing the size of the furnace, and commensurately, the footprint of the boiler. However, increasing size increases cost, shipping difficulties, and installation issues. The configuration set forth herein is able to reduce gas temperature within the same boiler footprint since the overall heating surface is increased. The reduction in heat flux directly correlates to an increase in water-tube life.

It will be noted that just as with a more conventional device, a boiler having this configuration can typically be operated as a multiple pass boiler via the installation of baffles within the convection section. Insulation (not shown) may be present within the housing, where required, to further prevent gas leakage or thermal loss.

While the invention has been described in reference to certain preferred embodiments, it will be readily apparent to one of ordinary skill in the art that certain modifications or variations may be made to the system without departing from the scope of invention claimed below and described in the foregoing specification.

What is claimed is:

1. A water-tube package boiler comprising:

a housing having a first side-wall and a second side-wall;

an upper cylindrical drum;

a lower cylindrical drum;

a radiant portion having a combustion chamber, defined by a set of membrane tubes and said upper drum and lower drum, where a combustion reaction takes place; and, a convection section, lying outside of said radiant portion, having a plurality of convection section water-tubes connecting said upper drum and lower drum; said convection section being bordered, on one side, by said set of membrane tubes;

a plurality of water-tubes, having a heating surface which essentially extends around the entire circumference of the water-tube along the full length of the tube, situated within the combustion chamber of the radiant portion and connecting said lower drum and said upper drum; and, wherein said plurality of water-tubes situated within the combustion chamber of the radiant portion comprises at least a first water-tube which has a portion of said first water-tube positioned at a location adjacent to said first side-wall and further comprises at least one second water-tube which has a portion of said second water-tube positioned at a location adjacent to said convection section.

2. A water-tube package boiler comprising:

a housing having two side-walls;

an upper cylindrical drum positioned within said housing;

a lower cylindrical drum positioned within said housing;

a first water-tube array comprising a first set and a second set of water-tubes connecting said upper drum and said lower drum and circumscribing a combustion chamber;

said first set of water-tubes defining a first furnace wall and said second set of water-tubes defining a second furnace wall;

a second water-tube array positioned at a location outside said combustion chamber and connecting said upper drum and said lower drum;

said second water-tube array not being directly exposed to gas within said combustion chamber, and, a third water-tube array, wherein each water-tube of the third water tube array has a heating surface which essentially extends around the entire circumference of the water-tube along the full length of the water-tube;

said third-water tube array comprising a first water-tube and a second water-tube which are wholly disposed within said combustion chamber and connect said upper drum and said lower drum; and, wherein said first-water tube is located at a position adjacent to said first furnace wall and said second-water tube is located at a position adjacent to said second furnace wall.

3. The boiler of claim 2 wherein said first water-tube array comprises radiant water-tubes connected to one another by welded steel fins.

4. The boiler of claim 3 wherein the water-tubes of said third water-tube array are situated proximate to the first water-tube array.

5. The boiler of claim 2 wherein said upper and lower drums are positioned adjacent to opposite sidewalls of said boiler.

* * * * *